United States Patent [19]

Wardlaw

[11] 4,325,913

[45] Apr. 20, 1982

[54] REAGENT PROBE AND METHOD FOR FABRICATION THEREOF

[75] Inventor: Stephen C. Wardlaw, Branford, Conn.

[73] Assignee: Coulter Electronics, Inc., Hialeah, Fla.

[21] Appl. No.: 198,523

[22] Filed: Oct. 20, 1980

[51] Int. Cl.[3] ..... B01L 3/02

[52] U.S. Cl. ..... 422/100; 73/864.01; 73/864.72; 222/420

[58] Field of Search ..... 422/100; 73/425.4 P, 73/425, 425.4 R, 864.01, 864.72; D24/55, 60, 61; 128/276; 222/211, 420, 421, 571, 572, 464, 376

[56] References Cited

U.S. PATENT DOCUMENTS

| | | | |
|---|---|---|---|
| D. 28,861 | 6/1898 | Wetherald | D24/61 |
| D. 31,035 | 6/1899 | Wetherald | D24/61 |
| D. 249,553 | 9/1978 | Sturm et al. | 73/425.4 P X |
| 2,703,984 | 3/1955 | Headings | 73/425 |
| 2,732,108 | 1/1956 | Haddad | 222/571 X |
| 3,815,604 | 6/1974 | O'Malley et al. | 128/276 X |
| 3,844,272 | 10/1974 | Banko | 128/276 X |
| 4,162,896 | 7/1979 | Hosli | 422/100 X |

FOREIGN PATENT DOCUMENTS

| | | | |
|---|---|---|---|
| 54-05492 | 1/1979 | Japan | 422/100 |

*Primary Examiner*—Kenneth M. Schor

*Attorney, Agent, or Firm*—Silverman, Cass & Singer, Ltd.

[57] ABSTRACT

A probe for aspirating and dispensing fluids is provided with a concave arcuate termination of the tubular bodywall forming a terminal orifice, in which the tip of the arcuate termination projects inwardly toward the tubular axis; the projection of the tip extends to a position at a distance in the range of approximately $\frac{1}{4}$ to about $\frac{3}{4}$ of the distance perpendicularly across the outside diameter of the bodywall.

4 Claims, 4 Drawing Figures

REAGENT PROBE AND METHOD FOR FABRICATION THEREOF

BACKGROUND OF THE INVENTION

This invention generally relates to probes for aspirating and dispensing fluids, and more particularly to probes for typical use in pipetting multiple liquids in laboratory analysis processes.

In modern laboratory analysis, for example analysis of blood serums, large numbers of serum samples, controls and other reagents must be processed in high speed, automatic equipment; such equipment is described in copending U.S. patent application Ser. No. 115,734, filed Jan. 28, 1980 in the names Ginsberg et al, entitled System and Probe for Chemical Reaction Observation With A Moving Photometer, which application is now allowed and is incorporated herein by reference. Such instruments can perform highly accurate determinations, but a recurring problem arises in cross-contamination between various specimens. Where a number of specimens are to be withdrawn from different containers and placed in analysis vessels, it is necessary that substantially no portion of the specimen taken from one container be introduced into another or different container. This contamination occurs commonly when a pipette, or probe, is used to aspirate or withdraw a multiple specimens, reagents, and other liquids; often, excess liquid adheres to the tip of the pipette probe which is immersed in a specimen or reagent for transfer of a portion to an analysis vessel, with the adhering excess liquid causing contamination of a succeeding specimen aspirated into the same probe.

Attempts made in the prior art to reduce the contamination problem have included rinsing of the transfer probe, however, such rinsing can draw some of the liquid sample from the tip, reducing volumetric accuracy. Use of compressed air to dry the tip may also tend to disturb the liquid in the interior of the tip causing droplets to be blown from the tip.

While many types of needlepoint probes have been developed such as those marketed by the Hamilton Company, no tip design has successfully eliminated drops from adhering to the exterior of the tip.

SUMMARY OF THE INVENTION

According to this invention, a probe for aspirating and dispensing fluids has been developed in which the probe is provided with a concave arcuate termination of a bodywall forming a terminal projection inwardly to a position at a distance in the range of approximately $\frac{1}{4}$ to about $\frac{3}{4}$ of the distance perpendicularly across the outside diameter of the bodywall. The concave arcuately shaped orifice and inwardly projecting tip eliminate hydraulic shock on entry of the probe at an air-liquid interface, and reduce the tendency of liquid drops to adhere to the tip.

DESCRIPTION OF THE PREFERRED EMBODIMENT

Figure 1:
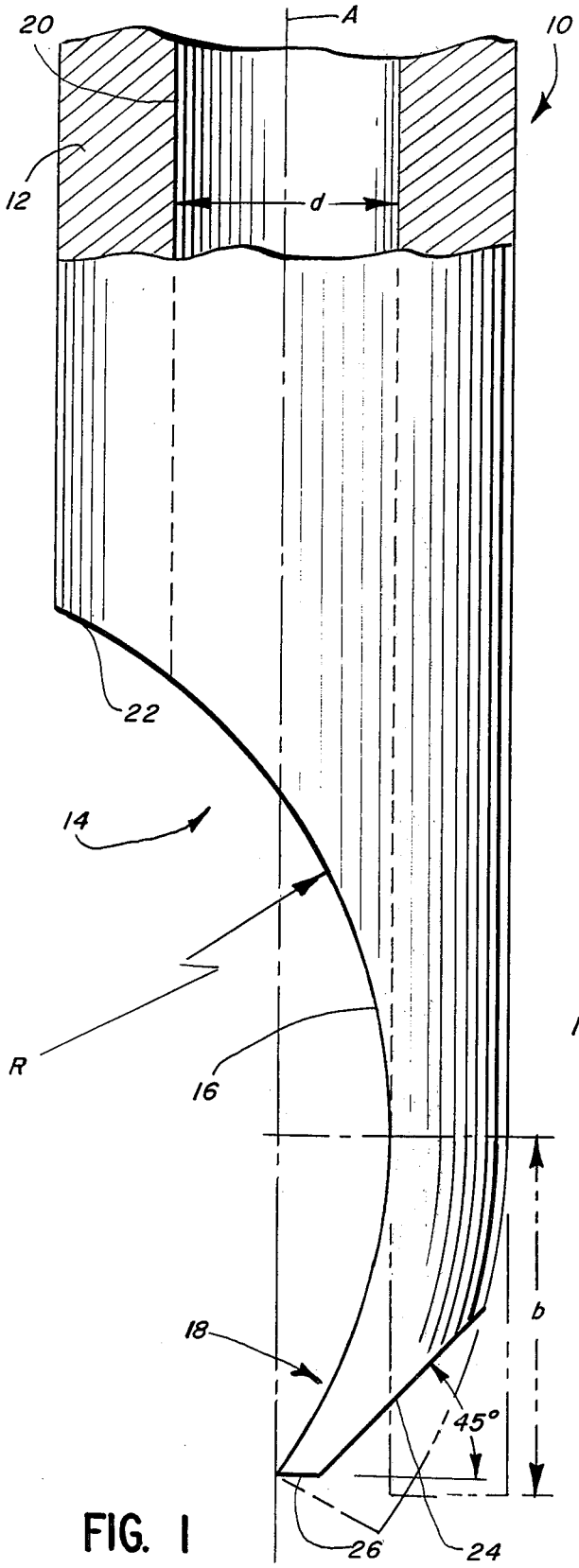
FIG. 1 is a side view, partially in the section, of an embodiment of the probe of this invention, showing the inward projection of the tip on the arcuately formed orifice.
Figure 2:
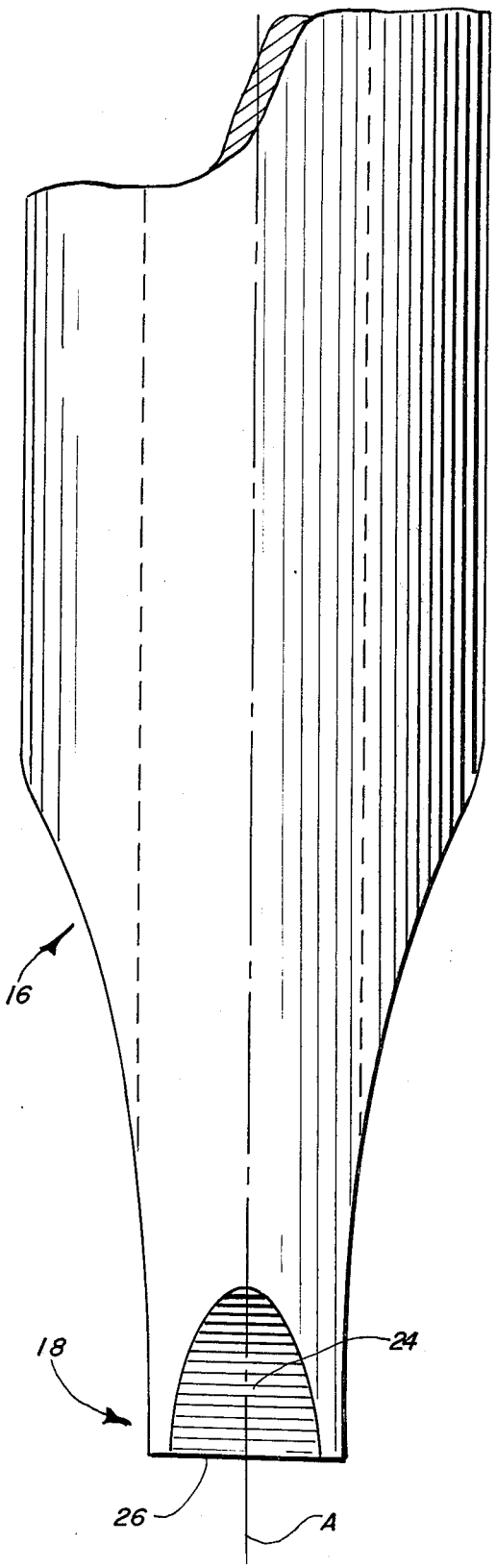
FIG. 2 is an end view of the probe shown in FIG. 1.

Referring to FIGS. 1 and 2, a probe in accordance with this invention is designated generally by the reference character 10. The tubular bodywall 12 of probe 10 has an outside diameter D and an inside diameter d with concentric axis A. Bodywall 12 is preferably fabricated from stainless steel or other material suitable for maintaining arcuate microvolume measurements. When used for aspirating and dispensing microvolumetric liquid samples, outer diameter D will be suitably in the range of approximately 0.03–0.08 inch and inner diameter d will be suitably in the range of approximately 0.015–0.55 inch; examples of successfully performing probes have been dimensioned with a thickness $(D-d)/2$ of the bodywall 12 as small as 0.005 inch.

The bodywall 12 terminates in an orifice generally designated 14 which is provided by a concave arcuate termination 16 formed on bodywall 2. The extremity of arcuate termination 16 is a tip formation 18 which projects inwardly to partially obstruct axial entry and exit of fluid from the bore 20 of probe 10. The partial obstruction of bore 20 by the inward projection of tip 18 reduces hydraulic shock upon rapid submersion of tip 18 below the surface of a liquid sample as the probe enters the liquid from an air-liquid interface. Suitably, the projection of tip 18 extends inwardly to a position at a distance in the range of about $\frac{1}{4}$ to about $\frac{3}{4}$ of the distance perpendicularly across the outer diameter D of bodywall 12; preferably the inward projection extends approximately $\frac{1}{3}$–$\frac{1}{2}$ of the distance across the outer diameter D. Development of the inward projection of the tip 18, according to this invention has enabled prevention of unwanted liquid being forced into bore 20. In addition, when the probe 10 is withdrawn from the surface of a liquid sample, the inward projection of tip 18 prevents liquid from being retracted from orifice 14, as experienced with probes having straight tips.

Preferably, the end 22 commencing the arcuate termination 16 is positioned on bodywall 12 giving arcuate termination 16 a somewhat oblique configuration in which the distance from tip 18 to end 22, as measured along axis A or a line parallel thereto, is within a range approximately 1 to 2 times the outside diameter D of bodywall 12; thus dimensioned, arcuate termination 16 will provide orifice 14 with a cross-sectional area preferably in a range approximately 1.5–3 times the cross-sectional area of bore 20, most preferably such ratio being approximately 1.5:1, to provide smooth, shock-free liquid entry and exit from bore 20.

Figure 3:
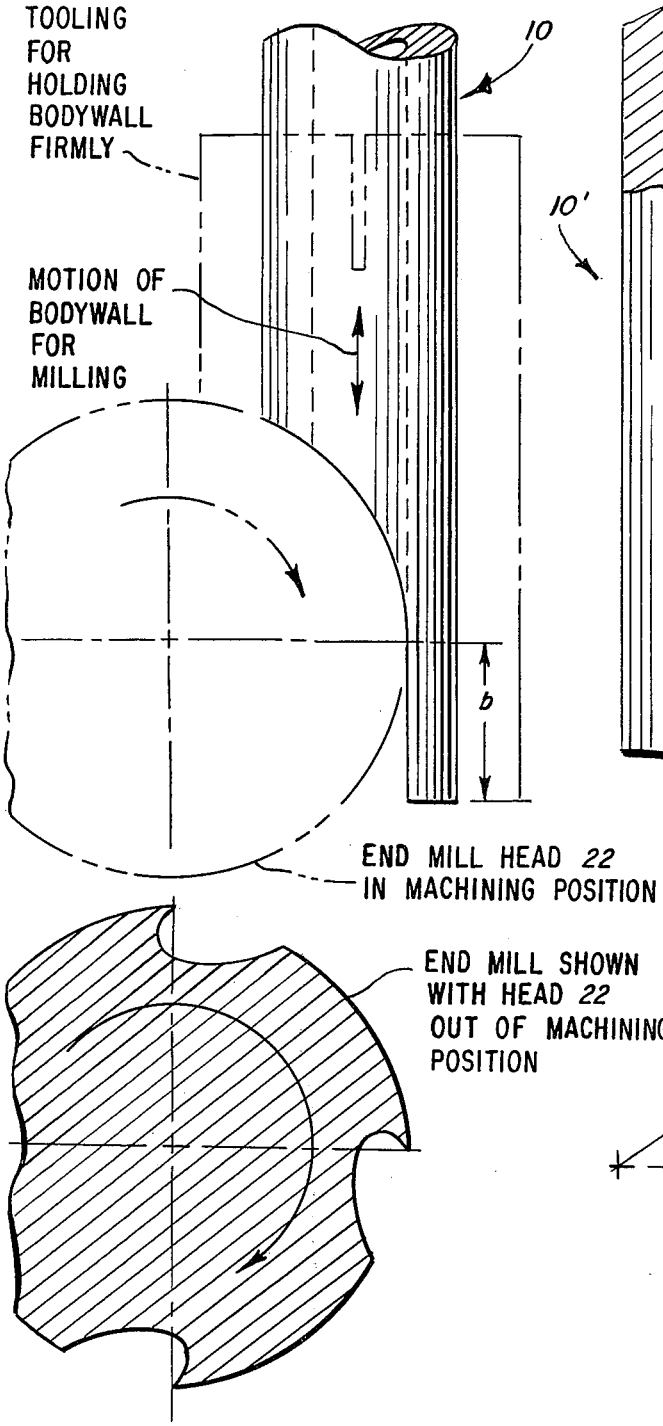
FIG. 3 is a schematic illustration of an end mill fabrication of the probe shown in FIG. 1.

Preferably, arcuate termination 16 is formed by cutting bodywall 12 with an end mill, as schematically illustrated in FIG. 3, having a machining head with radius chosen to provide arcuate termination 16 with radius R so that a plane perpendicular to axis A makes an angle a of at least approximately 20° with lines tangent to the arcuate termination 16. Radius R can be, for example, in the range 0.03–0.06.

In the preferred method of fabrication, the end mill can be oriented generally perpendicular to probe axis A so that bodywall 12, supported by surrounding tooling, is moved into the rotating end mill head 22, as shown in FIG. 3; initially, such milling can provide a substantially straight extremity portion b of bodywall 12 integral with the formed arcuate termination 16. The extremity portion b can then be inwardly bent, preferably around a mandrel (not shown), to achieve the inward projection of the tip 18 as previously described.

Preferably, after bending, tip 18 can be beveled, for example, by grinding or filing, to provide an outer or back surface 24 which is preferably flat and inclined with respect to a plane perpendicular to axis A; preferably, the angle of such incline is within a range of approximately 10°–45° as shown in FIG. 1. The flattened incline of back surface 24 minimizes the surface area of the tip, while maintaining its strength, so that liquid adhesion to the tip is reduced to such extent that it has been found that liquid drops no longer tend to adhere to the tip. In addition, tip 18 can be beveled to provide a preferably flat, leading face 26 lying in a plane generally perpendicular to axis A and intersecting back surface 24 as shown in FIG. 1.

Figure 4:
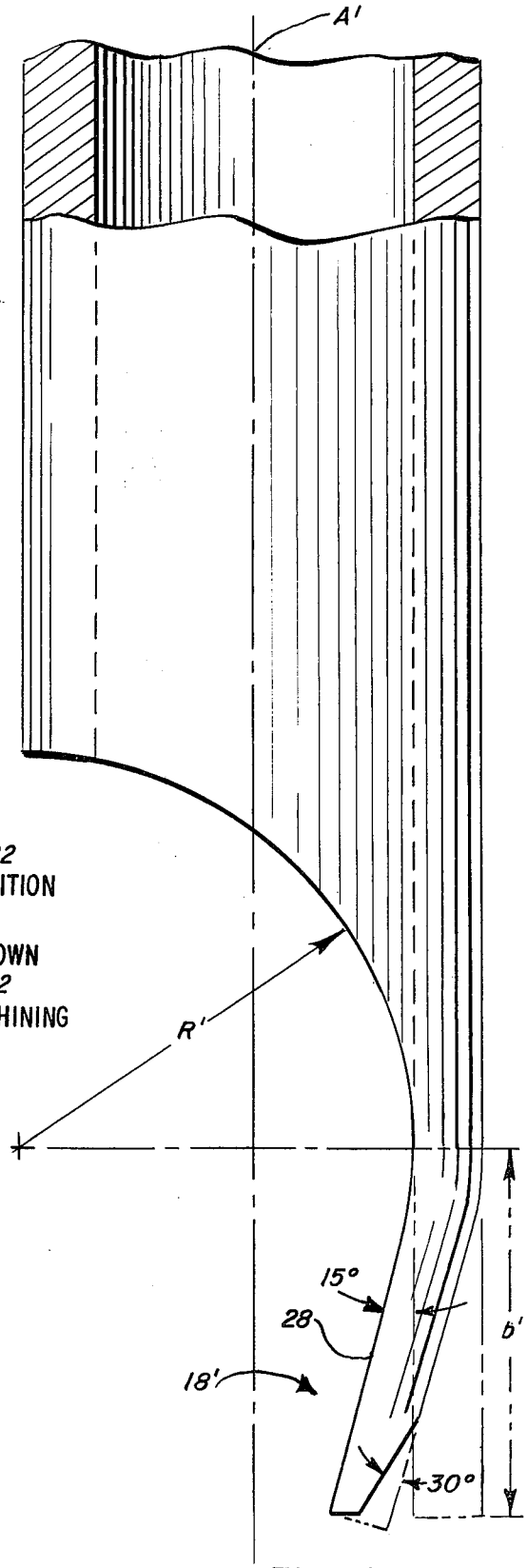
FIG. 4 is a side view, partially in the section, of a modified probe in accordance with this invention.

In a second embodiment of the probe according to this invention, as shown in FIG. 4, tip 18' can be further beveled to form a preferably flat inside surface 28 inclined at an angle of approximately 15 degrees with respect to axis A'.

Embodiments of the probe according to this invention have been demonstrated to reduce liquid adhesion to the tip and the cross-contamination problem, while maintaining acurately repetitive microvolumetric measurements. The embodiments shown in the drawings are illustrative of this invention but do not indicate limitation upon the scope of the claims.

I claim:

1. A probe for aspirating and dispensing fluids, comprising:

(A) a tubular bodywall having a terminal orifice formed by a substantially arcuate termination of said bodywall which arcuate termination is obliquely concave with respect to the interior of said bodywall; and (B) an inwardly projecting tip formed as the general extremity portion of said arcuate termination, wherein the projection of said tip extends inwardly in relation to said bodywall and the portion of said tip immediately adjacent to the end of said tip has a narrow, flat leading face lying in a plane generally perpendicular to the tubular axis of said bodywall so that said leading face is sufficiently narrow to only partially obstruct axial entry and exit of fluid through said orifice into said bodywall, said leading face being positioned at a distance in the range of about $\frac{1}{4}$ to about $\frac{3}{4}$ of the distance perpendicularly across the outside diameter of said bodywall.

2. The probe as claimed in claim 1, wherein a commencement end of said arcuate termination forming the end opposing said leading face of said tip is positioned on said bodywall such that the distance from said leading face to said commencement end, as measured along a line parallel to the tubular axis of said bodywall, is within a range of approximately 1 to 2 times the outside diameter of said bodywall.

3. The probe as claimed in claim 1, wherein:

said arcuate termination is formed such that a plane perpendicular to said tubular axis makes an angle of at least approximately 20° with all lines tangent to said arcuate termination.

4. The probe as claimed in claims 1, 2 or 3, wherein, said tip includes a beveled outer surface inclined at an angle within a range of approximately 10° to 45° with respect to planes perpendicular to said tubular axis.

* * * * *